US009379462B2

(12) United States Patent
Yu et al.

(10) Patent No.: US 9,379,462 B2
(45) Date of Patent: Jun. 28, 2016

(54) CABLE CONNECTOR AND METHOD OF MAKING THE SAME

(71) Applicant: ALLTOP ELECTRONICS (SUZHOU) LTD., Taicang, JiangSu (CN)

(72) Inventors: Wang-I Yu, Jhonghe (CN); Ren-Bao Hu, Jhonghe (CN); I-Hung Cheng, Jhonghe (CN)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/496,687

(22) Filed: Sep. 25, 2014

(65) Prior Publication Data

US 2016/0006157 A1 Jan. 7, 2016

(30) Foreign Application Priority Data

Jul. 2, 2014 (CN) ..... 2014 1 0311406

(51) Int. Cl.

| | |
|---|---|
| ***H01R 12/71*** | (2011.01) |
| ***H01R 12/51*** | (2011.01) |
| ***H01R 43/24*** | (2006.01) |
| ***H01R 12/53*** | (2011.01) |
| *H01R 43/20* | (2006.01) |
| *H01R 13/627* | (2006.01) |

(52) U.S. Cl.

CPC ..... *H01R 12/53* (2013.01); *H01R 13/6272* (2013.01); *H01R 43/205* (2013.01); *H01R 43/24* (2013.01)

(58) Field of Classification Search

CPC ..... H01R 43/24; H01R 23/7073; H01R 23/6873; H01R 13/5216; H01R 13/521; H01R 12/51; H01R 12/71

See application file for complete search history.

(56) References Cited

U.S. PATENT DOCUMENTS

| | | | | |
|---|---|---|---|---|
| 3,643,208 | A * | 2/1972 | Massa, Jr. | H01R 13/523 439/276 |
| 4,963,098 | A * | 10/1990 | Myer | H01R 13/514 439/248 |
| 5,641,307 | A * | 6/1997 | Gerrans | H01R 13/405 439/606 |
| 7,641,494 | B2 * | 1/2010 | Chen | H01R 13/5845 29/858 |
| 8,152,563 | B1 * | 4/2012 | Csak | H01R 13/504 439/606 |
| 2004/0097133 | A1 * | 5/2004 | Liu | H01R 13/405 439/606 |
| 2005/0014417 | A1 * | 1/2005 | Karino | H01R 13/5845 439/606 |
| 2005/0142940 | A1 * | 6/2005 | Manine | H01R 12/62 439/606 |
| 2006/0246779 | A1 * | 11/2006 | Helbok | H01R 13/5205 439/606 |
| 2013/0095676 | A1 * | 4/2013 | Wu | H01R 9/2408 439/76.1 |

* cited by examiner

*Primary Examiner* — Gary Paumen

(74) *Attorney, Agent, or Firm* — Sughrue Mion, PLLC

(57) ABSTRACT

A cable connector includes an insulative housing, at least one group of circuit boards retained on the insulative housing, cables connecting with the circuit boards electrically, and insulator fixing the insulative housing, the circuit boards and the cables together. The insulative housing has a first receiving space and a second receiving space. The first receiving space spaces apart from the second receiving space along a front to back direction. Each circuit board has a front part received in the first receiving space and a rear part received in the second receiving space. The front part is formed with electrical contacts. The cables connect with the rear parts. The insulator is insert-molded in the second receiving space and encloses the rear parts.

11 Claims, 8 Drawing Sheets

CABLE CONNECTOR AND METHOD OF MAKING THE SAME

BACKGROUND

1. Technical Field

The present disclosure relates to a cable connector, and more particularly to a cable connector with circuit boards and method of making the same.

2. Description of Related Art

The common cable connector, such as mini SAS HD cable connector, usually has two retaining mechanisms. One of the retaining mechanisms is formed to retain a group of PCBs (Print Circuit Board) along a top to bottom direction after soldering some cables to the PCB. Another retaining mechanism is formed by being insert-molded around the PCBs to enclose the welding spots between the cables and the PCBs. The above two retaining mechanisms and PCBs are secured by an insulative housing. As described above, the cable connector is formed intricately and needs many working procedures to accomplish each forming steps. Said working procedures usually can be not controlled easily. Besides, said two retaining mechanisms waste too much insulative material that results in high cost and is not environmentally.

It is desirable to provide an improved cable connector and method of making the same for solving above problems.

SUMMARY

In one aspect, the present invention includes a cable connector. The cable connector comprises an insulative housing having a first receiving space and a second receiving space, the first receiving space spacing apart from the second receiving space along a front to back direction; at least one group of circuit boards, each circuit board having a front part received in the first receiving space and a rear part received in the second receiving space, the front part being formed with electrical contacts; cables connecting with the rear parts of the circuit boards electrically; and an insulator being insert-molded in the second receiving space to enclose the rear parts.

In another aspect, the present invention further method of making a cable connector. The method comprises: providing an insulative housing, the insulative housing having a first receiving space and a second receiving space, the first receiving space spacing apart from the second receiving space along a front to back direction; providing at least one group of circuit boards and assembling the circuit boards to the insulative housing, each circuit board having a front part received in the first receiving space and a rear part received in the second receiving space, the front part being formed with electrical contact; providing cables and assembling the cables to the rear parts of the circuit boards; filling insulative material to the second receiving space to insert-mold an insulator, the insulator enclosing the rear parts.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE ILLUSTRATED EMBODIMENT

Figure 1:
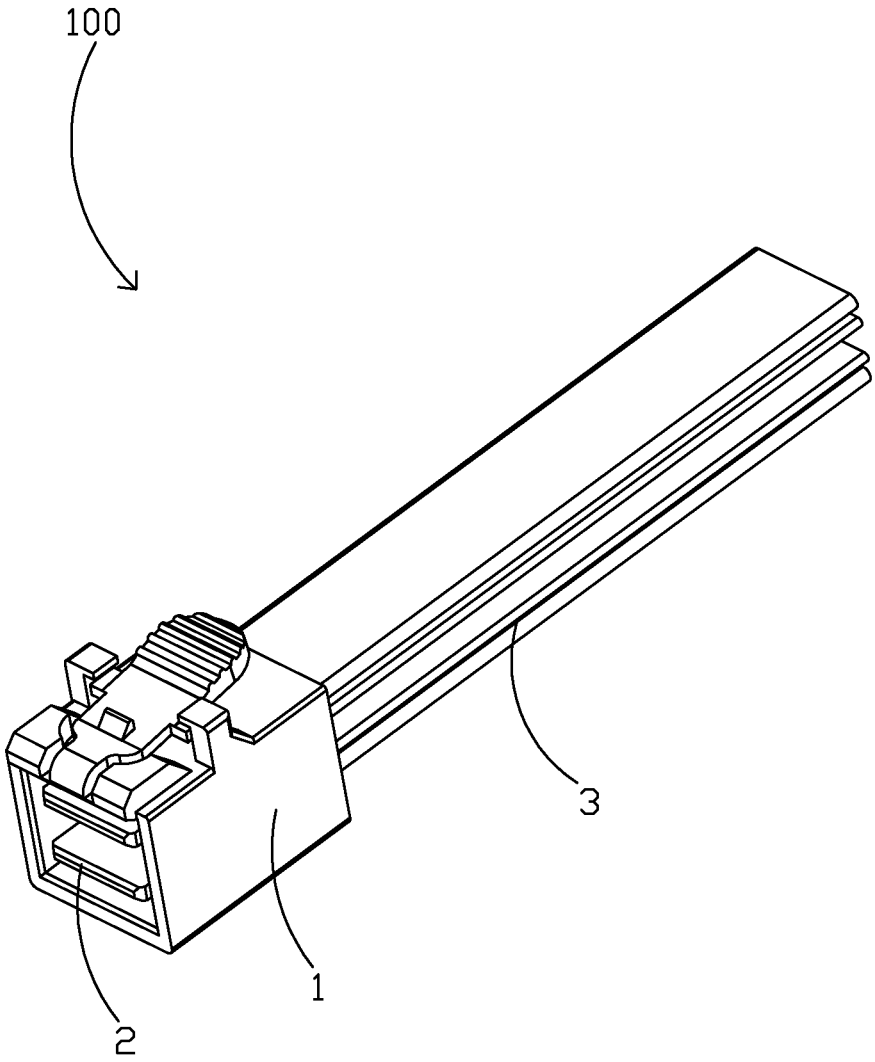
FIG. 1 is a perspective view of a cable connector in accordance with an illustrated embodiment of the present disclosure.

Reference will now be made to the drawing figures to describe the embodiments of the present disclosure in detail. In the following description, the same drawing reference numerals are used for the same elements in different drawings.

Figure 2:
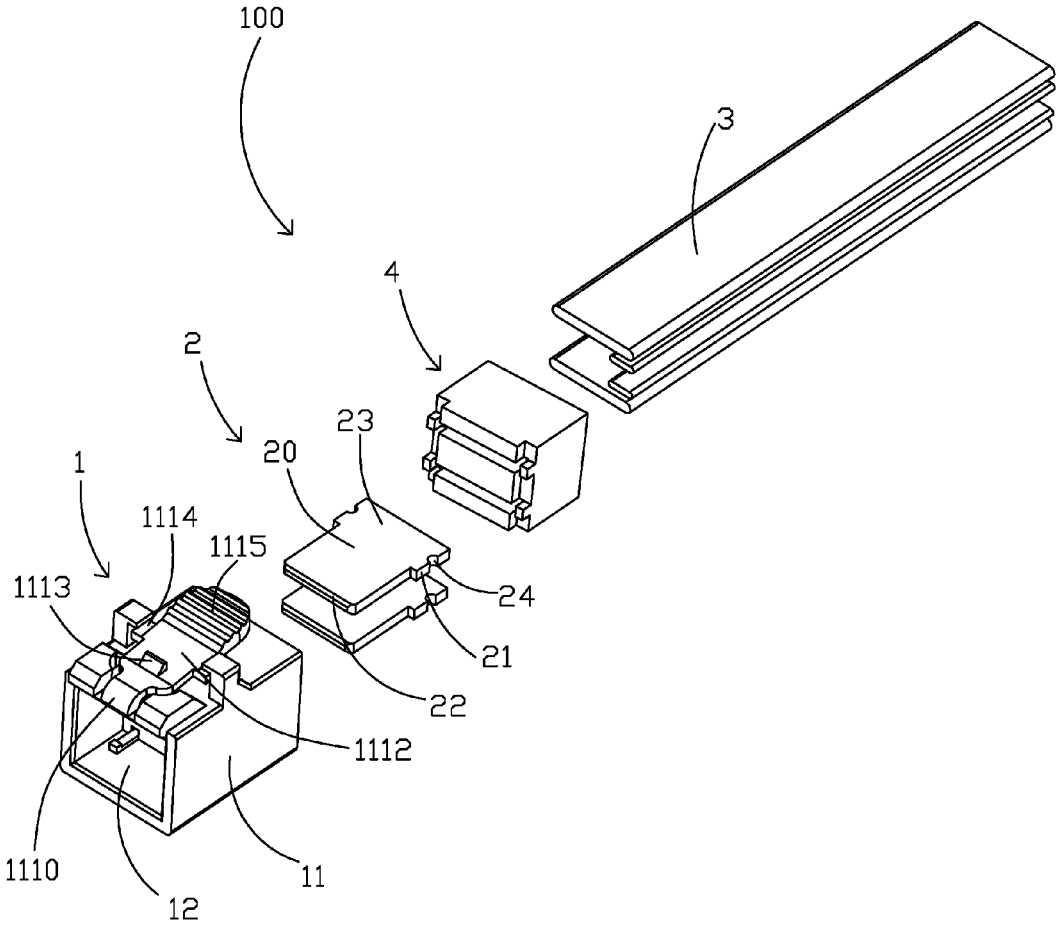
FIG. 2 is a partially exploded view of the cable connector shown in FIG. 1.
Figure 3:
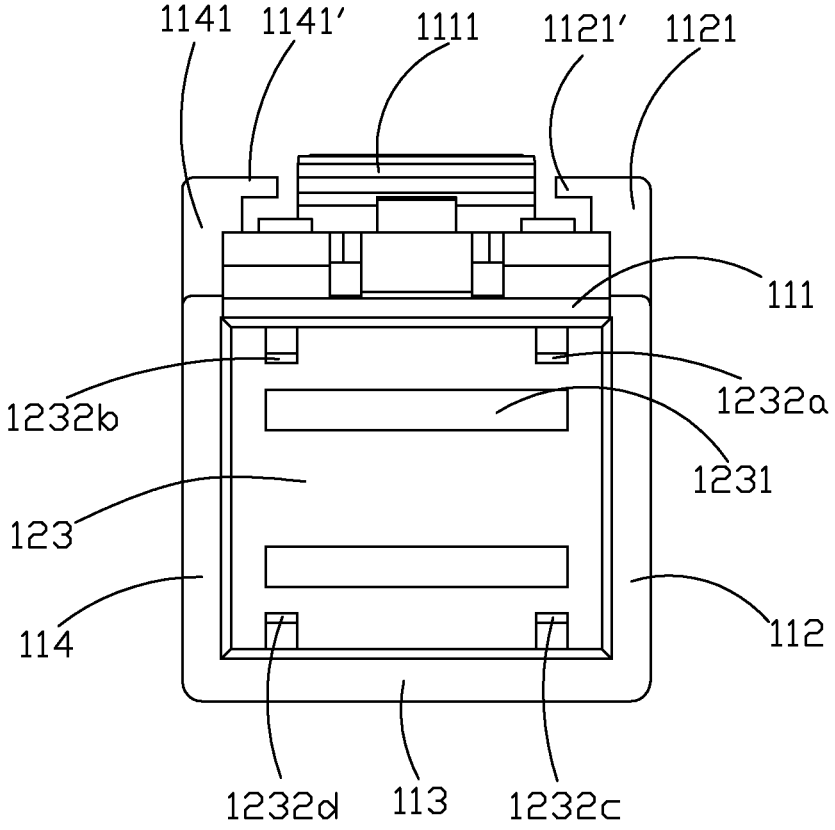
FIG. 3 is a front view of an insulative housing of the cable connector shown in FIG. 1.
Figure 4:
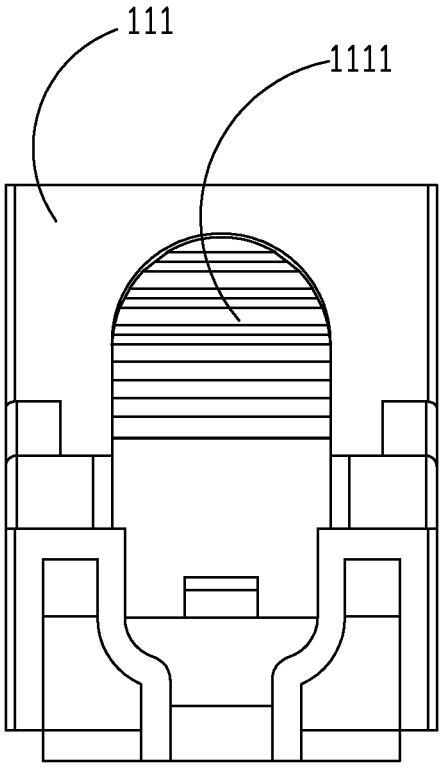
FIG. 4 is a top view of the insulative housing shown in FIG. 3.
Figure 5:
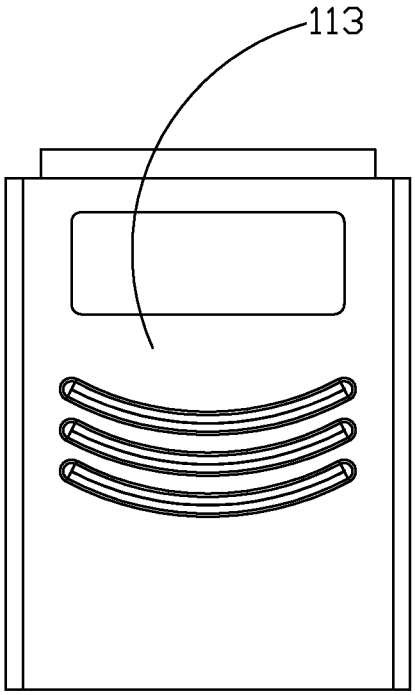
FIG. 5 is a bottom view of the insulative housing shown in FIG. 3.
Figure 6:
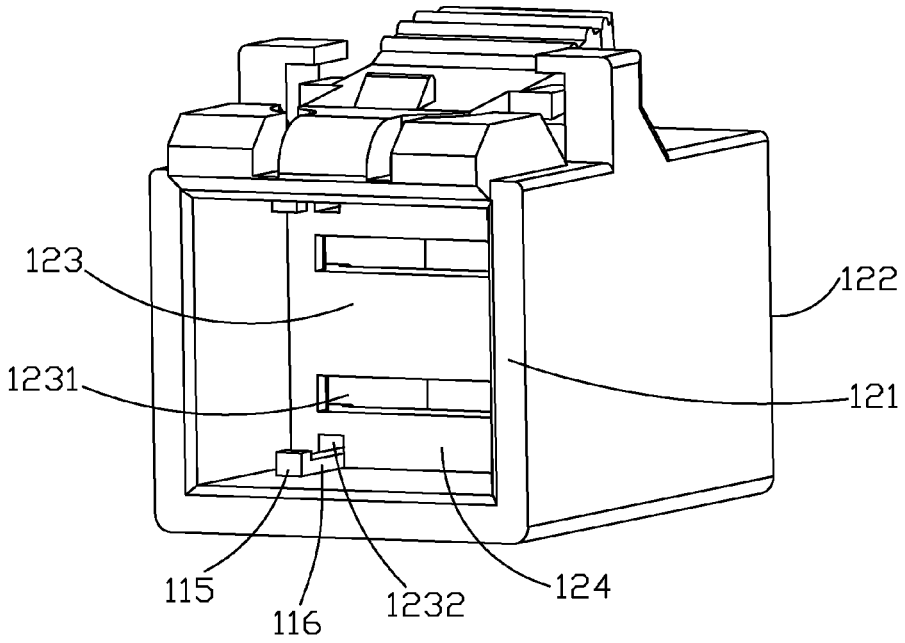
FIG. 6 is a perspective view of the insulative housing shown in FIG. 3.
Figure 7:
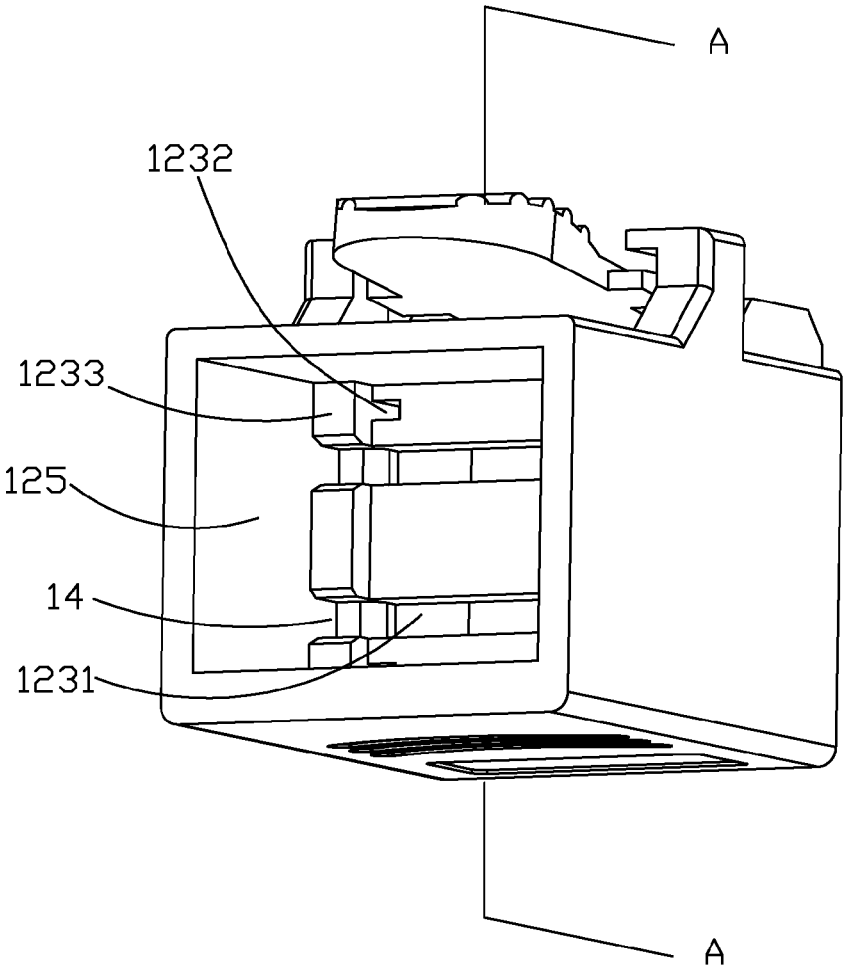
FIG. 7 is a view similar to FIG. 6, while viewed from another aspect.
Figure 8:
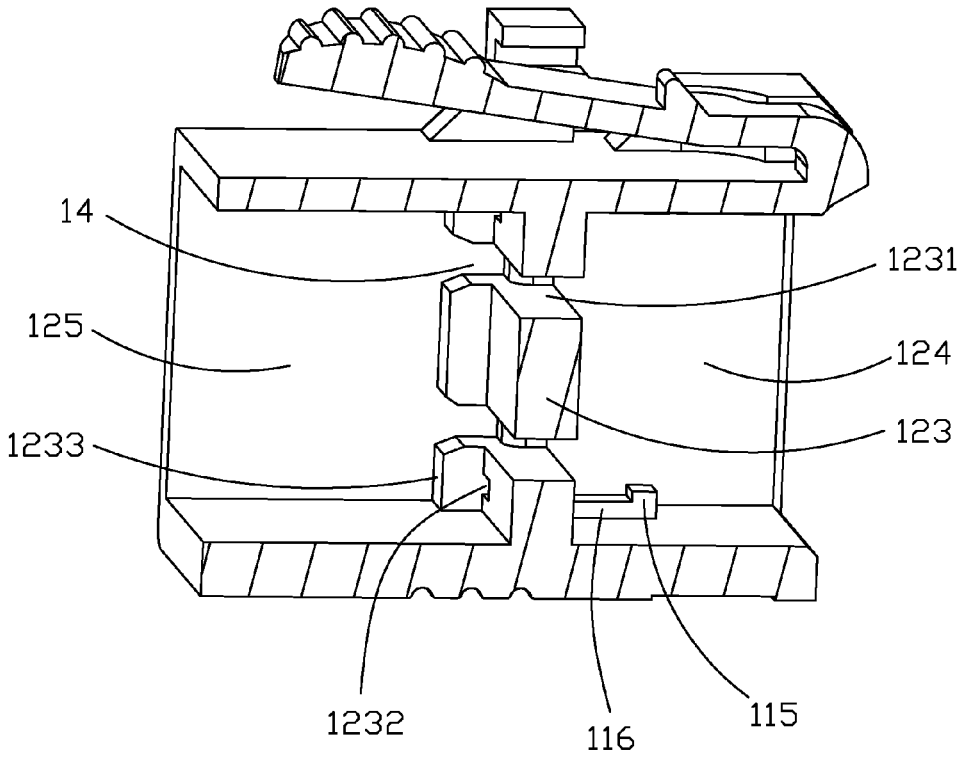
FIG. 8 is a cross-sectional view of the insulative housing taken along line A-A of FIG. 7.

Referring to FIGS. 1 to 2, an illustrated embodiment of the present disclosure discloses a cable connector 100 comprises an insulative housing 1, at least a group of circuit boards, cables 3 electrically connecting with the circuit boards, and an insulator 4 retaining the cables 3, circuit boards and the insulative housing 1. The group of circuit boards has two circuit boards 2 parallel to each other in the present invention.

Referring to FIGS. 2 to 5, the insulative housing 1 is rectangular, and has a top wall 111, a bottom wall 113, a pair of side walls connecting two sides of the top wall 111 and bottom wall 113, and an internal space 12 between the top wall 111, bottom wall 113 and side walls. The pair of side walls comprises a first side wall 112 and a second side wall 114. The internal space 12 extends along a front to back direction, and opens forward and backward.

The insulative housing 1 further has a first extension portion 1121 and a second extension portion 1141 upwardly extending from top ends of the side walls 112, 114 respectively, a first bending portion 1121' and a second bending portion 1141' extending toward each other from top ends of the first extension portion 1121 and the second extension portion 1141, and a spring arm 1111 extending from the top wall 111. The spring arm 1111 is located between the first extension portion 1121 and the second extension portion 1141, and has a linking portion 1110 connecting a front end of the top wall 111, and a movable portion 1112 backwardly extending from the linking portion 1110. The movable portion 1112 is formed with a locking protrusion 1113 at a front side thereof, a pair of projections 1114 below the first bending portion 1121' and the second bending portion 1141' and an operation portion 1115 at a rear side thereof.

Besides, referring to FIG. 3 and FIGS. 6 to 8, the insulative housing 1 has a front surface 121, a rear surface 122 and a separation wall 123 parallel to the front surface 121 and the rear surface 122. The separation wall 123 divides the internal space 12 of the insulative housing 1 to a first internal space 124 and a second internal space 125. The first internal space 124 spaces apart from the second internal space 125 along a front to back direction. The first internal space 124 is used to receive a mating connector (not shown), and the second internal space 125 is used to retaining the circuit boards 2 and the cables 3. Both the first internal space 124 and the second internal space 125 are formed on the insulative housing 1 in the present invention that can save at least one retaining mechanism of the common cable connector as described in the background. Thereby the material and cost for making the cable connector 100 would be decreased.

The separation wall 123 defines a pair of openings 1231 for supplying the circuit boards 2 crossing there through. The circuit boards 2 cross through the openings 1231 from the rear surface 122, and each of the circuit boards 2 is composed by a front part 22 received in the first internal space 124 and a rear part 23 received in the second internal space 125 along the front to back direction. The front part 22 is formed with electrical contacts to electrically contact with the mating connector. The rear part 23 is formed with welding spots (not shown) to connect with the cables 3. As described above, the first internal space 124 and the second internal space 125 are divided by the separation wall 123, and the openings 1231 are filled by the circuit boards 2; thereby the insulator 4 can only be insert-molded in the second internal space 125, and the electrical contacts on the front part 22 can be not affected in the molding process. The insulator 4 fixes the cables 3, the circuit boards 2 and the insulative housing 1 together, and encloses the welding spots.

Referring to FIGS. 2, 3 and FIGS. 6 to 8, the openings 1231 do not extend through the separation wall 123 along a transverse direction. The transverse direction is perpendicular to the front to back direction. Besides, the separation wall 123 defines a pair of limiting slots 14 at two sides of each opening 1231. The limiting slots 14 are recessed from a rear side of the separation wall 123 and doing not extending through the separation wall 123 forwardly. The limiting slots 14 communicate with the opening 1231 along the transverse direction. Each circuit board 2 is composed by a body portion 20 and a pair of limiting portions 21 at two sides of the body portion 20 along the transverse direction. The limiting portions 21 outwardly extend from two sides of the rear part 23 of the body portion 20. The limiting portions 21 abut against the front inner walls of the limiting slots 14 to prevent the circuit boards 2 from being inserted overly. Besides, the front sides of the limiting portions 21 are received in the limiting slots 14 for positioning the circuit boards 2. In the embodiment of the present invention, the separation wall 123 is formed with two ribs 1233 at rear side thereof. The ribs 1233 connect with the side walls, and are located at two sides of the openings 1231. The limiting slots 14 are recessed from the rear sides of the ribs 1233.

In order to stably secure the circuit boards 2 to the insulative housing 1, the circuit board 2 further defines a pair of cutouts 24 at two sides thereof. The cutouts 24 communicate with the second internal space 125 and are filled by the insulator 4, which can make the circuit boards 2 be secured by the insulator 4 stably. In the embodiment of the present invention, the limiting portions 21 occupy two sides of rear parts 23 of the circuit boards 2, thereby the cutouts 24 are recessed from outsides of the limiting portions 21.

Referring to FIG. 3 and FIGS. 6 to 8, in the embodiment of present invention, the circuit boards 2 are assembly by a tool. The insulative housing 1 defines two through holes 1232 at upper or lower side of each opening 1231 for making ways to the tool. In the present invention, the through holes 1232 comprise a first through hole 1232*a* and a second through hole 1232*b* at an upper side of the top one of the openings 1231, and a third through hole 1232*c* and a fourth through hole 1232*d* at a lower side of the lower one of the openings 1231. The first through hole 1232*a* and the second through hole 1232*b* are arranged close to the top wall 111, and the third through hole 1232*c* and the fourth through hole 1232*d* are arranged close to the bottom wall 113. The top wall 111 and the bottom wall 113 have a plurality of limiting blocks 115 protruding into the first internal space 124. The limiting blocks 124 correspond to the through holes 1232 along the front to back direction, and space apart from the through holes 1232 to limit an operating distance of the tool. For strengthening the limiting blocks 115, the top wall 111 and the bottom wall 113 are formed with a plurality of ribs 116 connecting a rear surface of the limiting blocks 115 and a front surface of the separation wall 123. The ribs 116 extend along the front to back direction.

Referring to FIGS. 1 to 8, in another aspect, the present invention further relates to a method of making the cable connector 100 as described above, and the method comprises: providing an insulative housing 1, the insulative housing 1 having a first internal space 124 and a second internal space 125, the first internal space 124 spacing apart from the second internal space 125 along a front to back direction; providing at least one group of circuit boards 2 and assembling the circuit boards 2 to the insulative housing 1, each circuit board 2 having a front part 22 received in the first internal space 124 and a rear part 23 received in the second internal space 125, the front part 22 being formed with electrical contact; then providing cables 3 and assembling the cables 3 to the rear parts 23 of the circuit boards 2; finally, filling insulative material to the second internal space 125 to insert-mold an insulator 4, the insulator 4 enclosing the rear part 23.

As described above, the cable connector 100 has a simple structure. Besides, both first and second receiving spaces 124, 125 being formed on the insulative housing 1 can make the assemblage of the circuit boards 2 be easier, and the assembling process would be simplified; on the other hand, at least one extra retaining mechanism and the material for making it are saved. Furthermore, the separation wall 123 between the first and second receiving spaces 124, 125 can avoid affecting the front parts 22 of the circuit boards 2 in the insert-molding process of the insulator 4; and on the other hand, the insulator 4 can fill the whole second internal space 125 to enclose the welding spots, thereby the cable connector 100 is stable and safe.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. A cable connector, comprising:

an insulative housing having a first receiving space and a second receiving space, the first receiving space spacing apart from the second receiving space along a front to back direction;

at least one group of circuit boards, each circuit board having a front part received in the first receiving space and a rear part received in the second receiving space, the front part being formed with electrical contacts;

cables connecting with the rear parts of the circuit boards electrically; and an insulator being insert-molded in the second receiving space to enclose the rear parts;

wherein each circuit board defines a pair of cutouts at two sides thereof, and the cutouts communicate with the second receiving space and are filled by the insulator.

2. The cable connector as claimed in claim 1, wherein the insulative housing has a front surface, a rear surface and a separation wall parallel to the front surface and the rear surface, and the separation wall divides the internal space of the insulative housing to the first receiving space and the second receiving space.

3. The cable connector as claimed in claim 2, wherein the separation wall defines openings for receiving the circuit boards crossing there through.

4. The cable connector as claimed in claim 3, wherein the openings do not extend through the separation wall along a transverse direction, the transverse direction being perpendicular to the front to back direction.

5. The cable connector as claimed in claim 4, wherein the separation wall defines a pair of limiting slots at two sides of each opening, the limiting slots being recessed from a rear side of the separation wall and doing not extending through the separation wall, each circuit board having a body portion and a pair of limiting portions outwardly extending from two sides of the body portion, the limiting portions abutting against the front inner walls of the limiting slots.

6. The cable connector as claimed in claim 5, wherein the insulative housing defines two through holes at upper or lower side of the openings for making ways to a tool used to assemble the circuit boards.

7. The cable connector as claimed in claim 6, wherein the insulative housing has a top wall, a bottom wall, a first side wall and a second side wall, the through holes being arranged close to the top wall or the bottom wall.

8. The cable connector as claimed in claim 7, wherein the top wall or the bottom wall has a plurality of limiting blocks protruding into the first receiving space, and the limiting blocks correspond to the through holes along the front to back direction.

9. The cable connector as claimed in claim 8, wherein the limiting blocks space apart from the through holes to limit an operating distance of the tool.

10. A method of making a cable connector as claimed in claim 1, comprising:

providing an insulative housing, the insulative housing having a first receiving space and a second receiving space, the first receiving space spacing apart from the second receiving space along a front to back direction;

providing at least one group of circuit boards and assembling the circuit boards to the insulative housing, each circuit board having a front part received in the first receiving space and a rear part received in the second receiving space, the front part being formed with electrical contact;

providing cables and assembling the cables to the rear parts of the circuit boards;

filling insulative material to the second receiving space to insert-mold an insulator, the insulator enclosing the rear parts.

11. The method of making a cable connector as claimed in claim 10, wherein the circuit boards are formed with welding spots for connecting with the cables, the insulator enclosing the welding spots.

* * * * *